US007549537B2

(12) United States Patent
Hsu

(10) Patent No.: US 7,549,537 B2
(45) Date of Patent: Jun. 23, 2009

(54) STEREOSCOPIC INNER SPACER

(75) Inventor: Fong-Ling Hsu, Tao Yuan (TW)

(73) Assignee: Quanta Computer Inc., Tao Yuan Shien (TW)

( * ) Notice: Subject to any disclaimer, the term of this patent is extended or adjusted under 35 U.S.C. 154(b) by 379 days.

(21) Appl. No.: 11/703,071

(22) Filed: Feb. 7, 2007

(65) Prior Publication Data

US 2008/0073418 A1 Mar. 27, 2008

(30) Foreign Application Priority Data

Sep. 27, 2006 (TW) ..... 95135869 A

(51) Int. Cl.
*B65D 73/00* (2006.01)

(52) U.S. Cl. ..... 206/486; 206/592

(58) Field of Classification Search ..... 206/486, 206/525, 525.1, 521, 583, 591, 592, 594, 206/775, 784; 229/120.11, 120.13, 120.28
See application file for complete search history.

(56) References Cited

U.S. PATENT DOCUMENTS

| | | | | |
|---|---|---|---|---|
| 4,026,411 | A * | 5/1977 | Johnson | 206/784 |
| 6,302,274 | B1 * | 10/2001 | Ridgeway | 206/583 |
| 6,769,543 | B2 * | 8/2004 | Hsu | 206/486 |
| 6,997,323 | B2 * | 2/2006 | Maresh et al. | 206/592 |
| 7,097,042 | B2 * | 8/2006 | Hsu | 206/591 |
| 7,097,043 | B2 * | 8/2006 | Hsu | 206/784 |
| 7,258,235 | B2 * | 8/2007 | Liu et al. | 206/591 |
| 7,344,029 | B2 * | 3/2008 | Sattora et al. | 206/592 |

* cited by examiner

*Primary Examiner*—Luan K Bui
(74) *Attorney, Agent, or Firm*—Rabin & Berdo, PC

(57) ABSTRACT

A stereoscopic inner spacer composed of paper materials is described. The stereoscopic inner spacer is formed by buckling and folding. The stereoscopic inner spacer may be put in a packaging carton to provide separating compartments to support and hold objects in the packaging carton, thereby preventing the objects from damage caused by impacts and prevent the objects from damage resulting from mutual collisions.

20 Claims, 11 Drawing Sheets

STEREOSCOPIC INNER SPACER

RELATED APPLICATIONS

The present application is based on, and claims priority from, Taiwan Application Serial Number 95135869, filed Sep. 27, 2006, the disclosure of which is hereby incorporated by reference herein in its entirety.

FIELD OF THE INVENTION

The present invention relates to a stereoscopic inner spacer, and more particularly, to a stereoscopic inner spacer implemented inside a packaging carton to provide support and protection to objects therein.

BACKGROUND OF THE INVENTION

Inside most packaging cartons used daily, there are protective packaging structures to support and protect objects disposed in the packaging cartons, thereby preventing damage caused by external impacts. Inside the commonly-used packaging cartons, the frequently-used materials used for the protective packaging structures are plastic, paper, and metal, etc., wherein paper is the most popular material selected when manufacturing the packaging structures because paper is easier to process, has low technical threshold, has low cost, and is easily to be printed on.

Nevertheless, comparing plastic or metal, the impact-resistibility and water-resistibility of the packing structures made of paper are insufficient. Moreover, for very precise and fairly fragile electrical components, which are easy to be damaged during transportation by external interference, such as water, dust, impact and so on, the requirements for the packaging structure are stricter. To reduce the damage to objects during transportation, the protective packaging structure must be waterproof, dust-proof, and shockproof. Currently, the relatively popular method is to insert lots of inner spacers, paper or plastic lining materials, foamed plastic fillers, or foamed cushioning pads, etc. into a packaging carton, so as to not only effectively separate the objects therein to prevent damages caused by collision, but also to provide the objects therein extra protection to prevent the impact caused by shaking during transportation.

In addition, based on the principle of environment protection, the packaging structures of paper can be produced by reprocessed paper pulp and be recycled. Moreover, unlike other materials, paper materials do not need to bear the cost of recycling. Therefore, the utilization of paper materials can reduce the ecological impact and have the advantage of low cost.

Presently, the fabrication technique of paper packaging structures by directly hot pressing paper pulp into a mold is quite common. Another method is to cut cardboard into various planks by first sampling and drawing parallel lines according to the size of the required object; and then folding and pasting the planks according to the required style to fabricate the inner spacer required.

However, the producing method of packaging structures by directly hot pressing paper pulp into a mold needs to develop and fabricate the mold, so that the cost is increased. Besides, the packaging structure made by folding and pasting paper sheets has the drawbacks of poor impact-resistibility, and it takes more time to produce.

SUMMARY OF THE INVENTION

One objective of the present invention is to provide a stereoscopic inner spacer by folding and buckling, so as to have the advantages of easily producing, thus saving the fabricating time and enhancing the fabricating efficiency.

Another objective of the present invention is to provide a stereoscopic inner spacer, which is made of paper materials, to reduce the burden on the environment and fulfill the requirement of environmental protection.

Still another objective of the present invention is to provide a stereoscopic inner spacer by folding and buckling a paper sheet, so as to have the advantages of not needing to develop and fabricate molds, thus saving the cost of developing and fabricating the molds to reduce the expense.

According to the aforementioned objectives, the present invention provides a stereoscopic inner spacer, suitable for supporting a plurality of objects in a packaging carton, and the stereoscopic inner spacer comprises: a top plate including a first side, a second side opposite to the first side, a third side and a fourth side opposite to the third side, and comprising a first portion and a second portion, wherein the first portion is set with a first buckling piece, a second buckling piece, a third buckling piece and a fourth buckling piece respectively corresponding to the first side, the second side, the third side and the fourth side of the top plate; a first side plate comprising a first side piece, a first bottom piece and a second side piece connected to the first side of the top plate in sequence; a second side plate comprising a third side piece, a second bottom piece and a fourth side piece connected to the second side of the top plate in sequence, wherein the fourth side piece comprises a buckling portion protruding in the second bottom piece, a first buckling hole is formed between the second bottom piece and the fourth side piece after folding the fourth side piece, the second bottom piece is set with a second buckling hole, and the second bottom piece is further set with a first buckling opening and a second buckling opening respectively located on two opposites sides of the second bottom piece adjacent to the second side of the top plate; a third side plate comprising a fifth side piece and a first inserted piece connected to a portion of the third side of the top plate in sequence, and a first support piece, a third bottom piece and a fifth buckling piece connected to another portion of the third side of the top plate in sequence, wherein the fifth buckling piece is set with a third buckling hole; and a fourth plate comprising a sixth side piece and a second inserted piece connected to a portion of the fourth side of the top plate in sequence, and a second support piece, a fourth bottom piece and a sixth buckling piece connected to another portion of the fourth side of the top plate in sequence, wherein the sixth buckling piece is set with a fourth buckling hole, the portion of the third side and the portion of the fourth side of the top plate are on two opposite sides of the first portion of the top plate, and the first support piece and the second support piece are folded downward to provide support under the top plate; wherein, the second side plate is located under the top plate after folding, the first buckling piece is buckled into the first buckling hole, the second buckling piece is buckled into the second buckling hole, the third buckling piece is buckled into the first buckling opening and the third buckling hole, and the fourth buckling piece is buckled into the second buckling opening and the fourth buckling hole, so as to form an open deposed space in the first portion of the top plate; wherein, the first side plate, the fifth side piece, the sixth side piece, the first inserted piece, the second inserted piece and the second portion of the top plate are folded to form a rectangular deposed space under the top plate.

According to a preferred embodiment of the present invention, the first side plate further comprises a first connection piece connected to the second side piece and opposite to the first bottom piece, and the second side plate further comprises a second connection piece connected to the fourth side piece and opposite to the second bottom piece, wherein the second connection piece is located between the second portion of the top plate and the first connection piece.

According to another preferred embodiment of the present invention, the third buckling hole is located between the fifth buckling piece and the third bottom piece, and is formed after folding the fifth buckling piece. The fourth buckling hole is located between the sixth buckling piece and the fourth bottom piece, and is formed after folding the sixth buckling piece.

BRIEF DESCRIPTION OF THE DRAWINGS

The foregoing aspects and many of the attendant advantages of this invention are more readily appreciated as the same become better understood by reference to the following detailed description, when taken in conjunction with the accompanying drawings, wherein.

DETAILED DESCRIPTION OF THE EMBODIMENT

The present invention discloses a stereoscopic inner spacer made by folding and buckling a paper sheet. The stereoscopic inner spacer can provide two separated deposed spaces to respectively hold a product and product accessories and prevents damage caused by collision thereby protecting the objects from impacts. In order to make the illustration of the present invention more explicit, the following description is stated with reference to FIG. 1 through FIG. 4.

Figure 1:
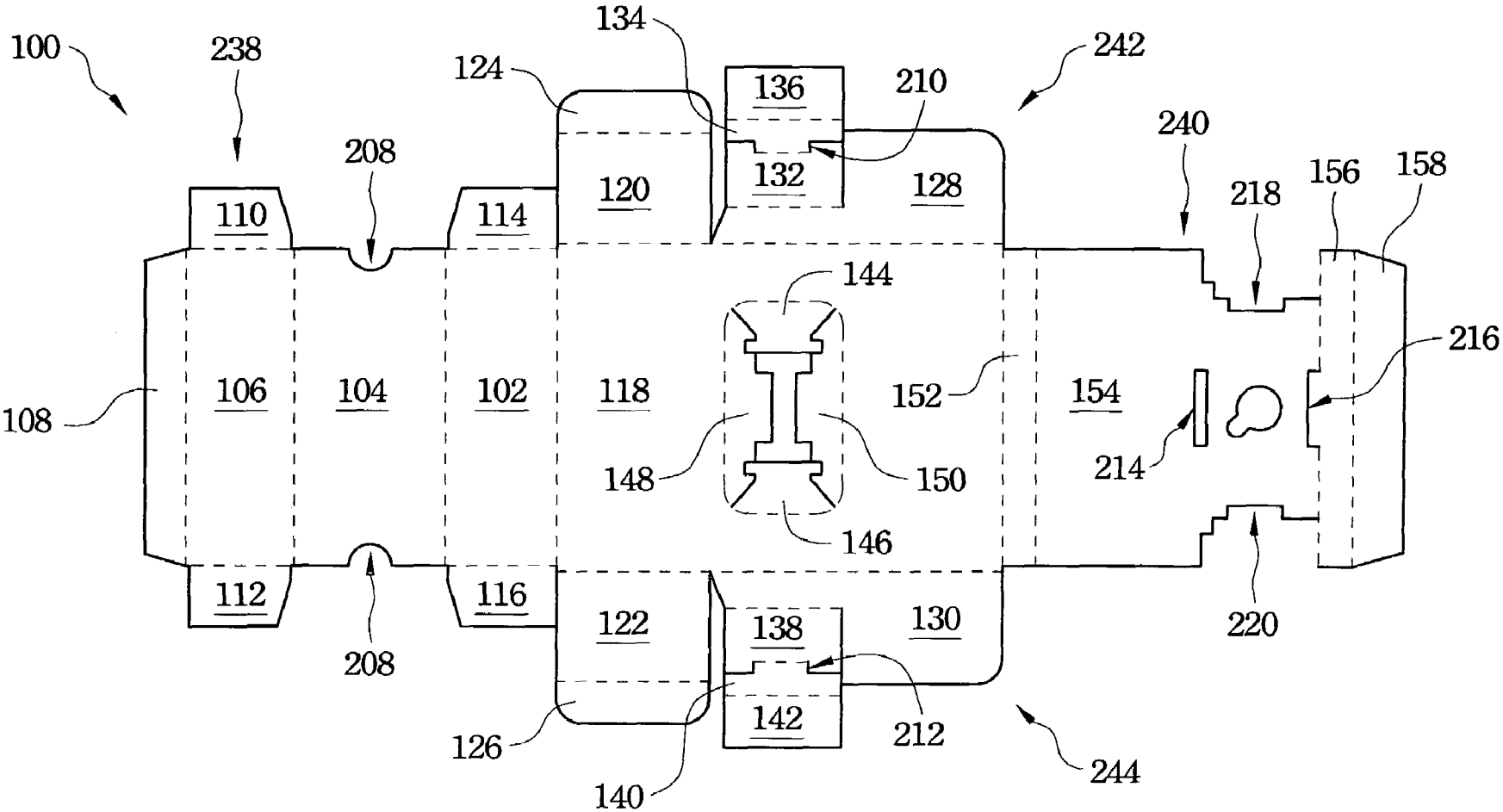
FIG. 1 illustrates a diagram showing an unfolded stereoscopic inner spacer according to a preferred embodiment of the present invention.

FIG. 1 is a diagram showing an unfolded stereoscopic inner spacer according to a preferred embodiment of the present invention. In the present invention, a stereoscopic inner spacer 100 is preferably composed of a flexible thin plank and formed in one piece, and a material of the stereoscopic inner spacer 100 is preferably a paper material having a buffer layer, such as corrugated paper, bond paper and so on, to fulfill the requirement of environmental protection and to provide the objects deposed therein with protection. The stereoscopic inner spacer 100 comprises a top plate 118, and a side plate 238, a side plate 240, a side plate 242 and a side plate 244 respectively connected to four sides of the top plate 118, wherein the side plate 238 and the side plate 240 are located on two opposite sides of the top plate 118, and the side plate 242 and the side plate 244 are located on the other two opposite sides of the top plate 118, as illustrated in FIG. 1.

The top plate 118 is divided into at least two portions, wherein one portion is set with a buckling piece 148, a buckling piece 150, a buckling piece 144 and a buckling piece 146, and the other portion is kept plane. The buckling piece 148, the buckling piece 150, the buckling piece 144 and the buckling piece 146 also respectively correspond to the four sides of the top plate 118, wherein the buckling piece 148 corresponds to the side of the top plate 118 where the side plate 238 is located, the buckling piece 150 corresponds to the side of the top plate 118 where the side plate 240 is located, the buckling piece 144 corresponds to the side of the top plate 118 where the side plate 242 is located and the buckling piece 146 corresponds to the side of the top plate 118 where the side plate 244 is located, as illustrated in FIG. 1.

In the present invention, the side plate 238 comprises a side piece 102, a bottom piece 104 and a side piece 106 connected to the top plate 118 in sequence. In the present preferred embodiment, the side plate 238 further comprises a connection piece 108 and four cover pieces 110, 112, 114 and 116, wherein the connection piece 108 is connected to the side piece 106 and is opposite to the bottom piece 104, the cover pieces 110 and 112 are respectively set at two opposite sides of the side piece 106 and are adjacent to the connection piece 108, and the cover pieces 114 and 116 are respectively set at two opposite sides of the side piece 102 and are adjacent to the top plate 118. In the present invention, the bottom piece 104 is further set with two openings 208 at two opposite sides of the bottom piece 104, as illustrated in FIG. 1.

In the present invention, the side plate 240 comprises a side piece 152, a bottom piece 154 and a side piece 156 connected to the top plate 118 in sequence, wherein the side piece 156 comprises a buckling portion 216 protruding in the bottom piece 154. After folding the side piece 156, a buckling hole 228 (as illustrated in FIG. 2C) is formed between the bottom piece 154 and the side piece 156. The bottom piece 154 is set with a buckling hole 214 through the bottom piece 154, and is further set with a buckling opening 218 and a buckling opening 220, wherein the buckling opening 218 and the buckling opening 220 are respectively located on two opposites sides of the bottom piece 154 adjacent to the top plate 118. As illustrated in FIG. 1, each of the buckling opening 218 and the buckling opening 220 is a sawtooth opening. In the present preferred embodiment, the side plate 240 further comprises a connection piece 158, wherein the connection piece 158 is connected to the side piece 156 and is opposite to the bottom piece 154.

In the present invention, the side plate 242 comprises a side piece 120 and an inserted piece 124 connected to a portion of the top plate 118 in sequence, and a support piece 128, a bottom piece 132 and a buckling piece 134 connected to another portion of the top plate 118 in sequence, wherein the buckling piece 134 is set with a buckling hole 210. The buckling hole 210 may be set to pass through the buckling piece 134, or the buckling hole 210 may be set between the buckling piece 134 and the bottom piece 132 and is formed after the buckling piece 134 is folded, such as shown in FIG. 1. In the present preferred embodiment, the side plate 242 further comprises a connection piece 136, wherein the connection piece 136 is connected to the buckling piece 134 and is opposite to the bottom piece 132.

Similarly, in the present invention, the side plate 244 comprises a side piece 122 and an inserted piece 126 connected to a portion of the top plate 118 in sequence, and a support piece 130, a bottom piece 138 and a buckling piece 140 connected to another portion of the top plate 118 in sequence, wherein the buckling piece 140 is set with a buckling hole 212. The buckling hole 212 may be set to pass through the buckling piece 140, or the buckling hole 212 may be set between the buckling piece 140 and the bottom piece 138 and is formed after the buckling piece 140 is folded, such as shown in FIG. 1. In the present preferred embodiment, the side plate 244 further comprises a connection piece 142, wherein the connection piece 142 is connected to the buckling piece 140 and is opposite to the bottom piece 138. The side piece 120 and the inserted piece 124, and the side piece 122 and the inserted piece 126 are respectively on two opposite sides of the top plate 118.

Figure 2A:
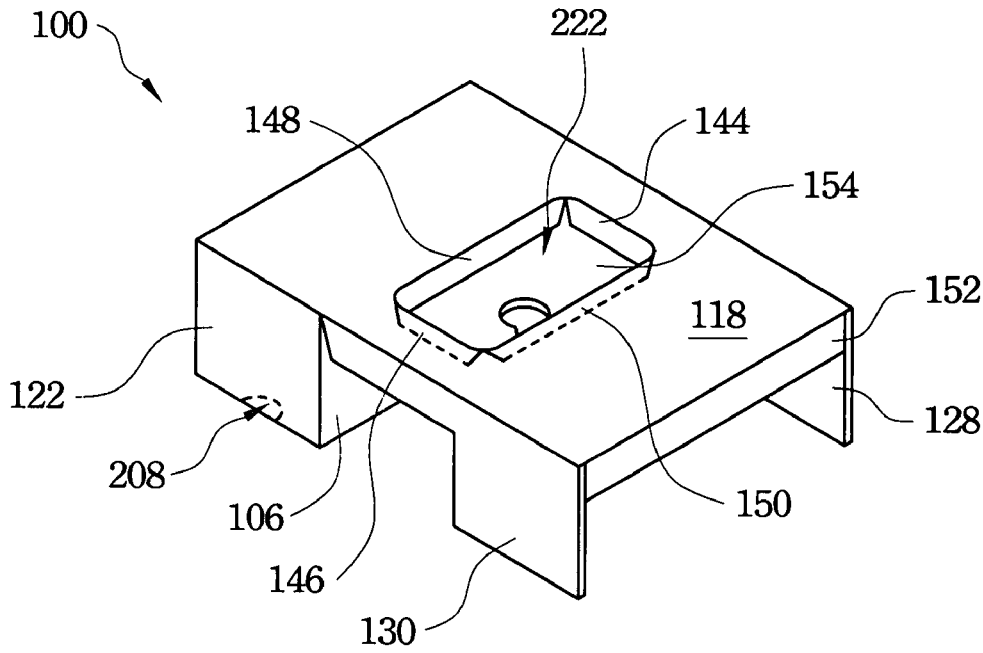
FIG. 2A illustrates a lateral view of a stereoscopic inner spacer according to a preferred embodiment of the present invention.
Figure 2B:
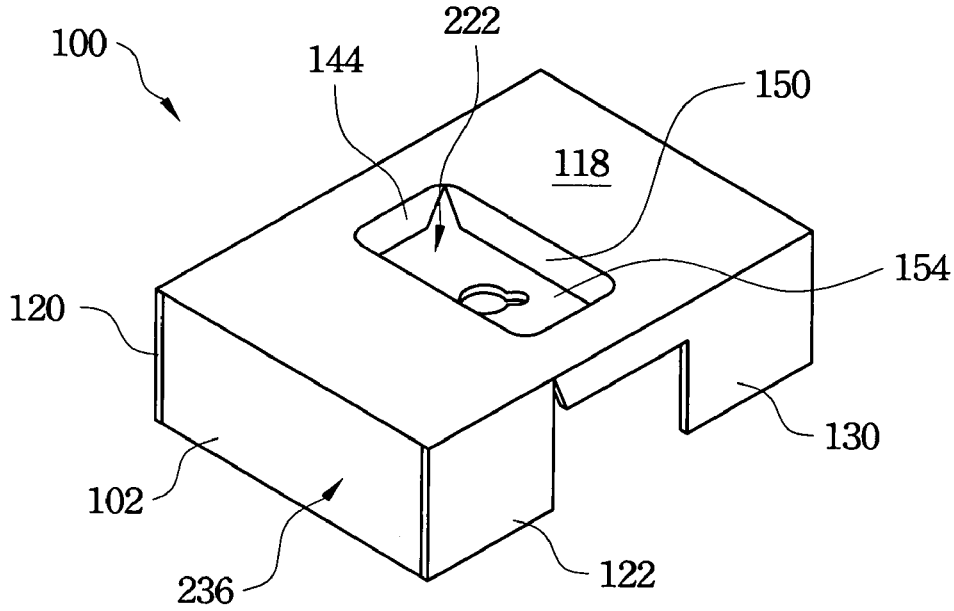
FIG. 2B illustrates a rear view of a stereoscopic inner spacer according to a preferred embodiment of the present invention.
Figure 2C:
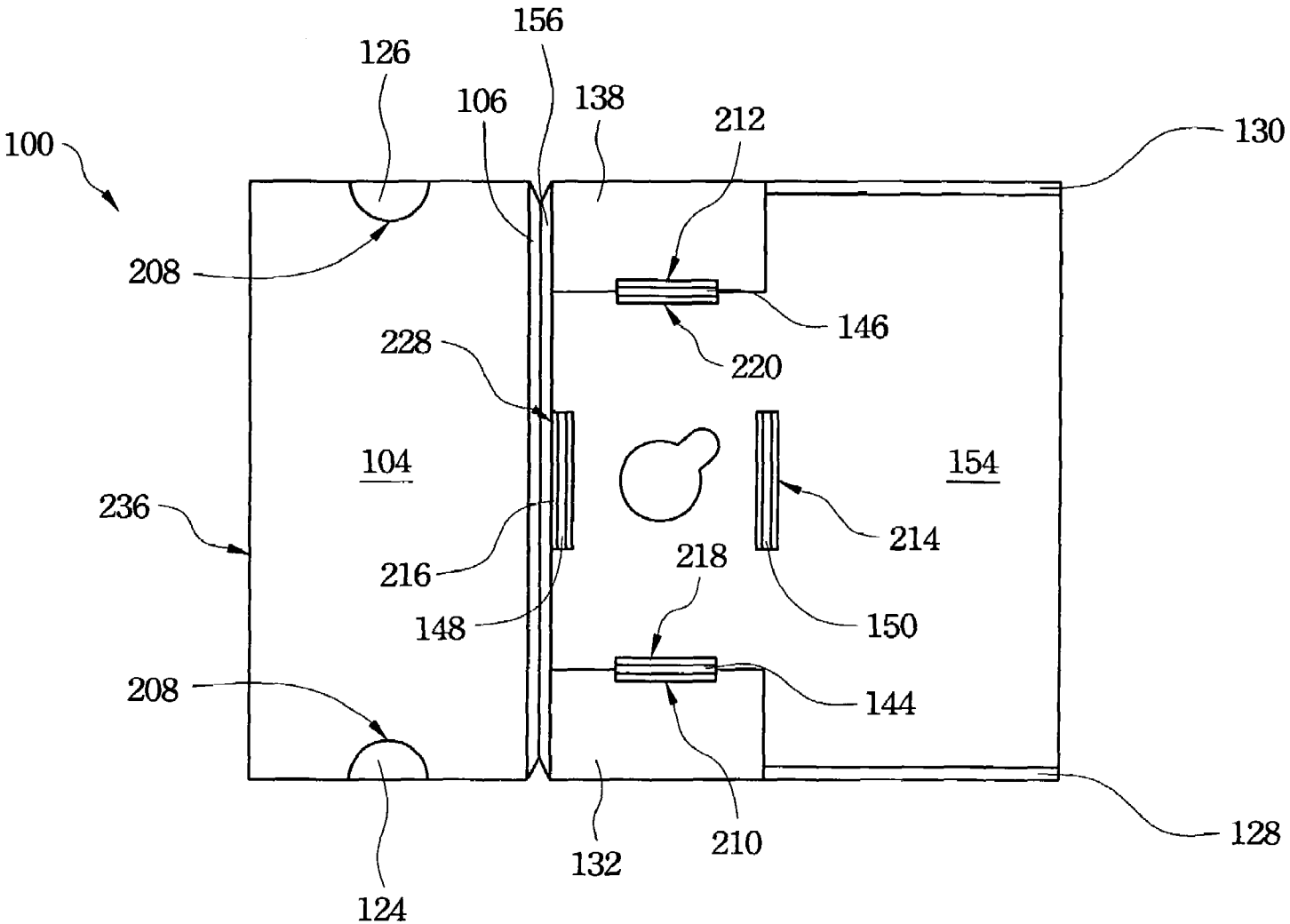
FIG. 2C illustrates a bottom view of a stereoscopic inner spacer according to a preferred embodiment of the present invention.

Referring to FIGS. 2A through 2C, wherein FIGS. 2A through 2C respectively illustrate a lateral view, a back view and a bottom view of a stereoscopic inner spacer according to a preferred embodiment of the present invention. After folding and fabricating, the stereoscopic inner spacer 100 includes an open deposed space 222, such as shown in FIG. 2A, and a hidden rectangular deposed space 236, such as shown in FIG. 2B and FIG. 2C.

Figure 3A:
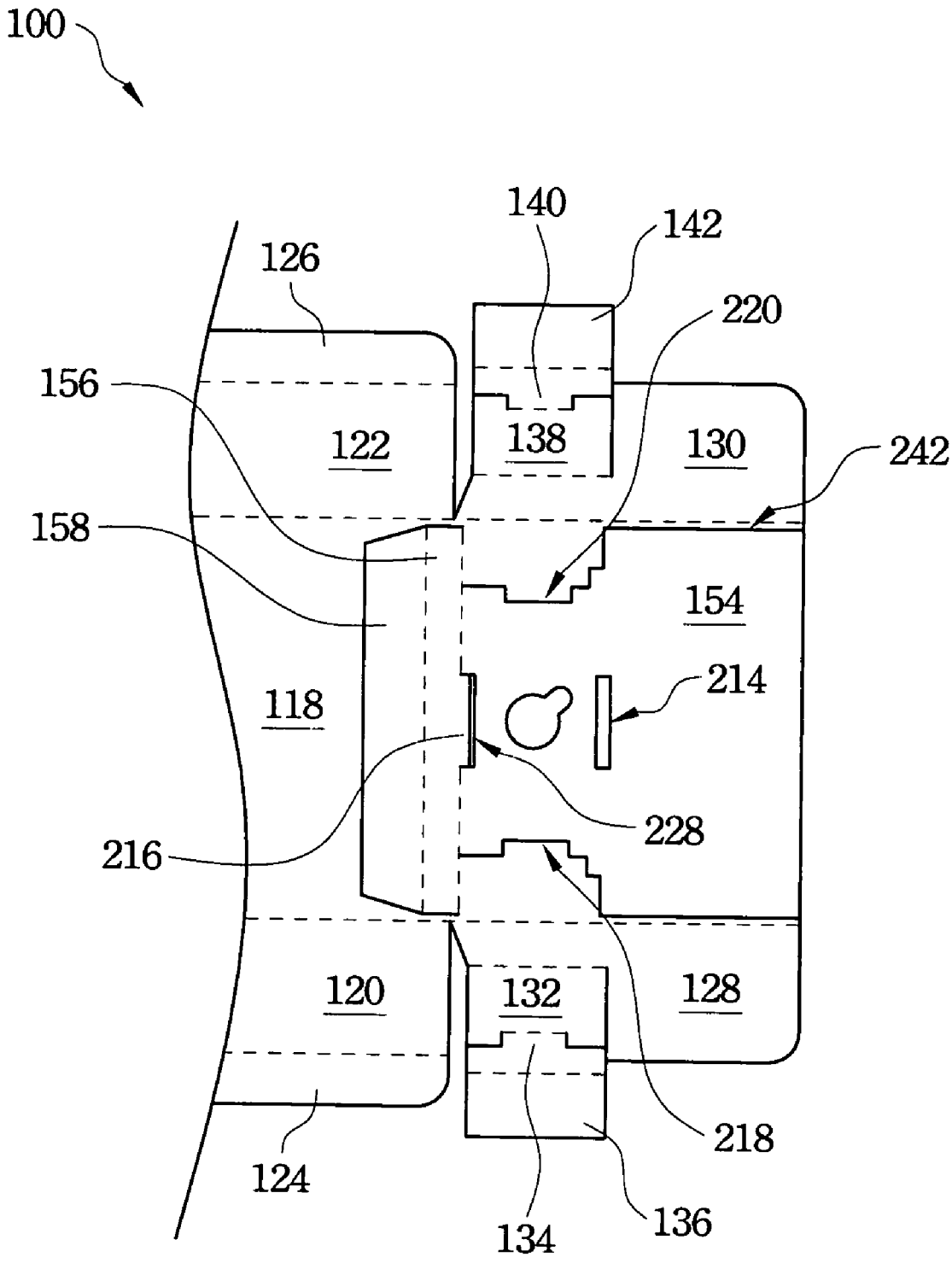
FIG. 3A through FIG. 3G are assembly diagrams showing a stereoscopic inner spacer in accordance with a preferred embodiment of the present invention.

FIG. 3A through FIG. 3G are assembly diagrams showing a stereoscopic inner spacer in accordance with a preferred embodiment of the present invention. When the stereoscopic inner spacer 100 is fabricated, the side plate 242 is folded inward top plate 118 to make the side plate 242 under the top plate 118, wherein the side piece 152 is located on the side of the top plate 118 and under the top plate 118, the bottom piece 154 is located under the top plate 118, and the buckling opening 218 and the buckling opening 220 are respectively adjacent to the buckling piece 144 and the buckling piece 146, such as shown in FIG. 3A and FIG. 1.

Figure 3B:
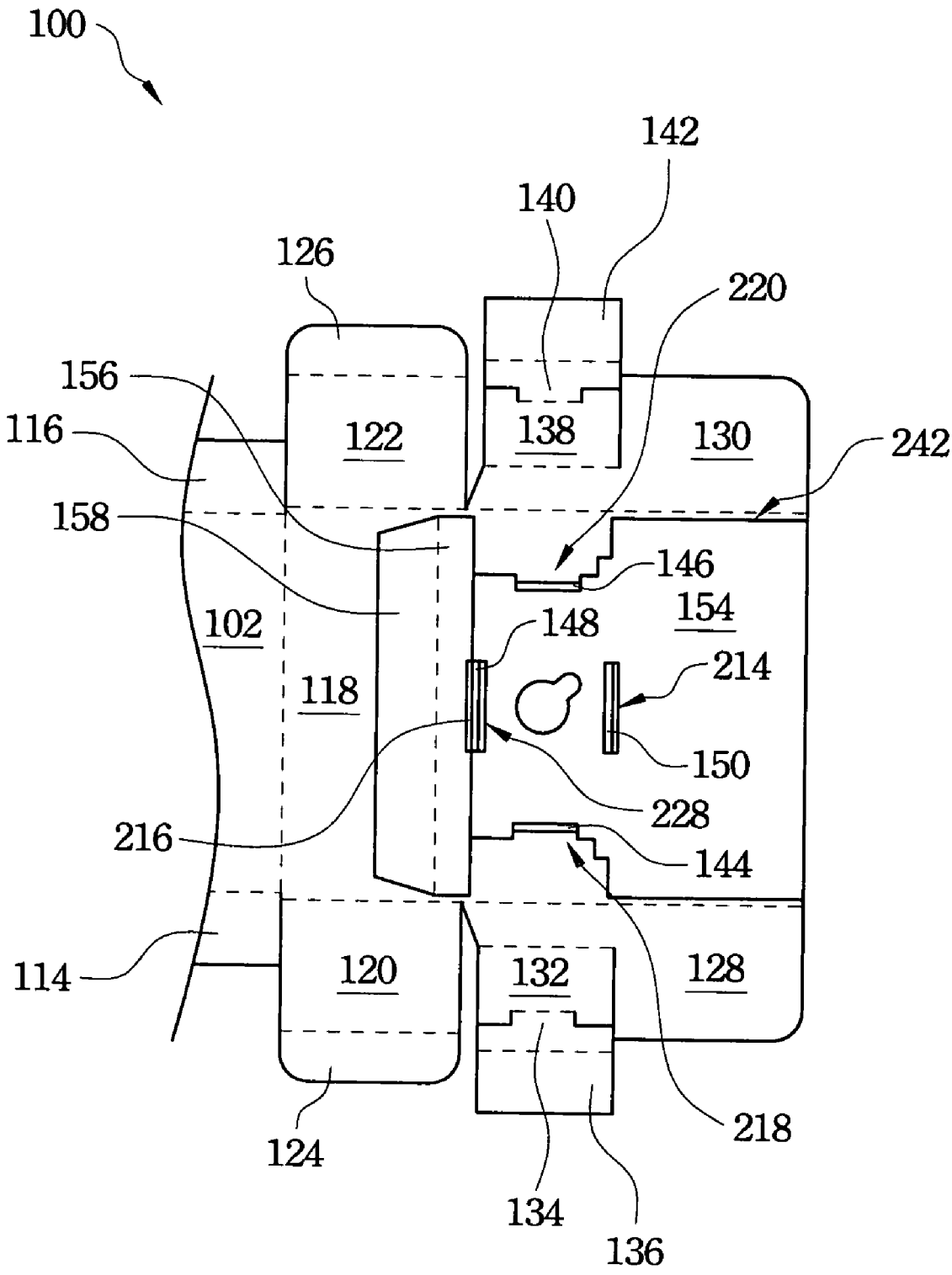
Figure 3C:
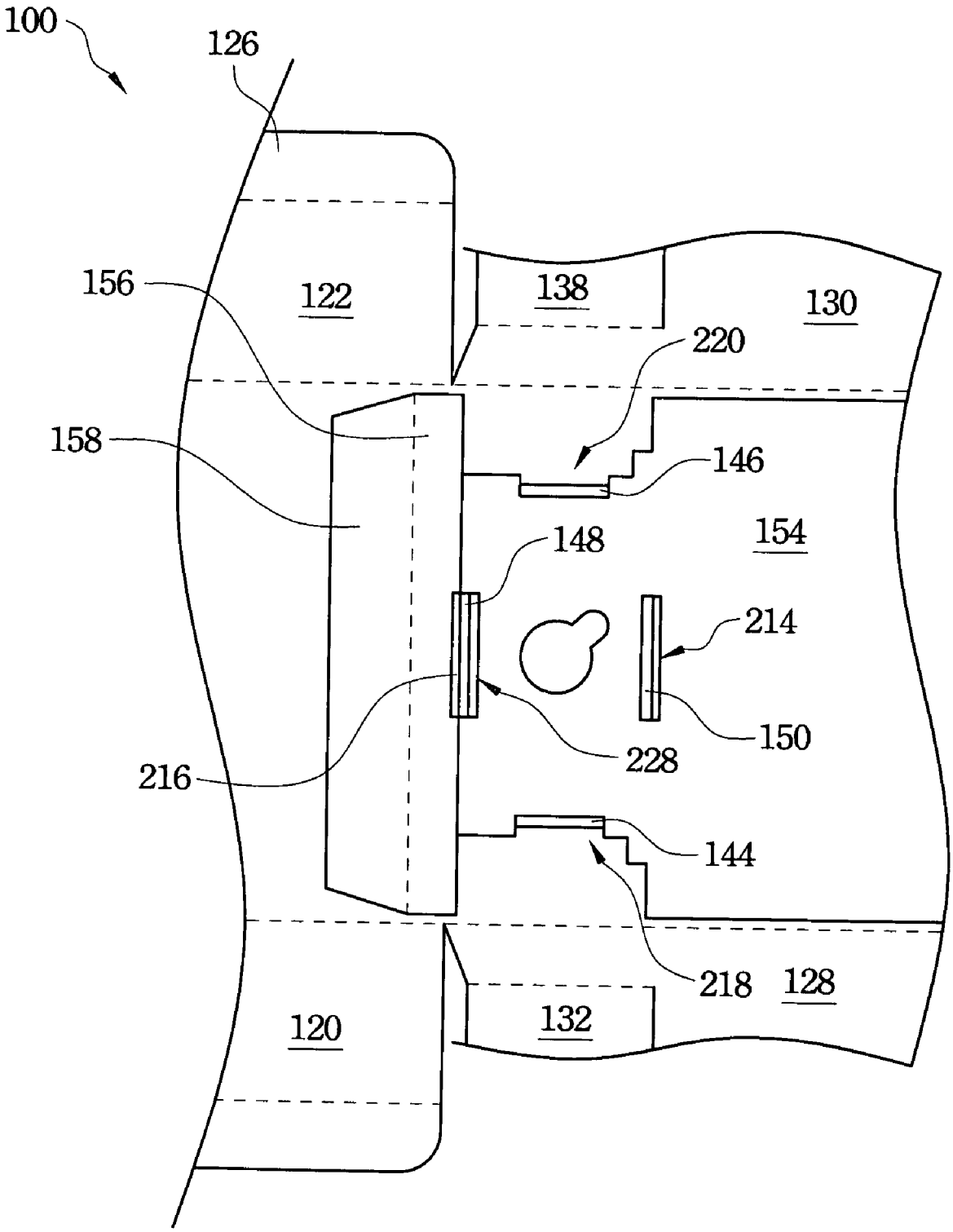

Then, the buckling piece 144, the buckling piece 146, the buckling piece 148 and the buckling piece 150 of the top plate 118 are pressed downward, so as to make the buckling piece 144 stick and buckle in the buckling opening 218, to make the buckling piece 146 stick and buckle in the buckling opening 220, to make the buckling piece 148 stick and buckle in the buckling hole 228, and to make the buckling piece 150 stick and buckle in the buckling hole 214, such as shown in FIG. 3B and FIG. 3C, wherein the FIG. 3C is an enlarged drawing of FIG. 3B.

Figure 3D:
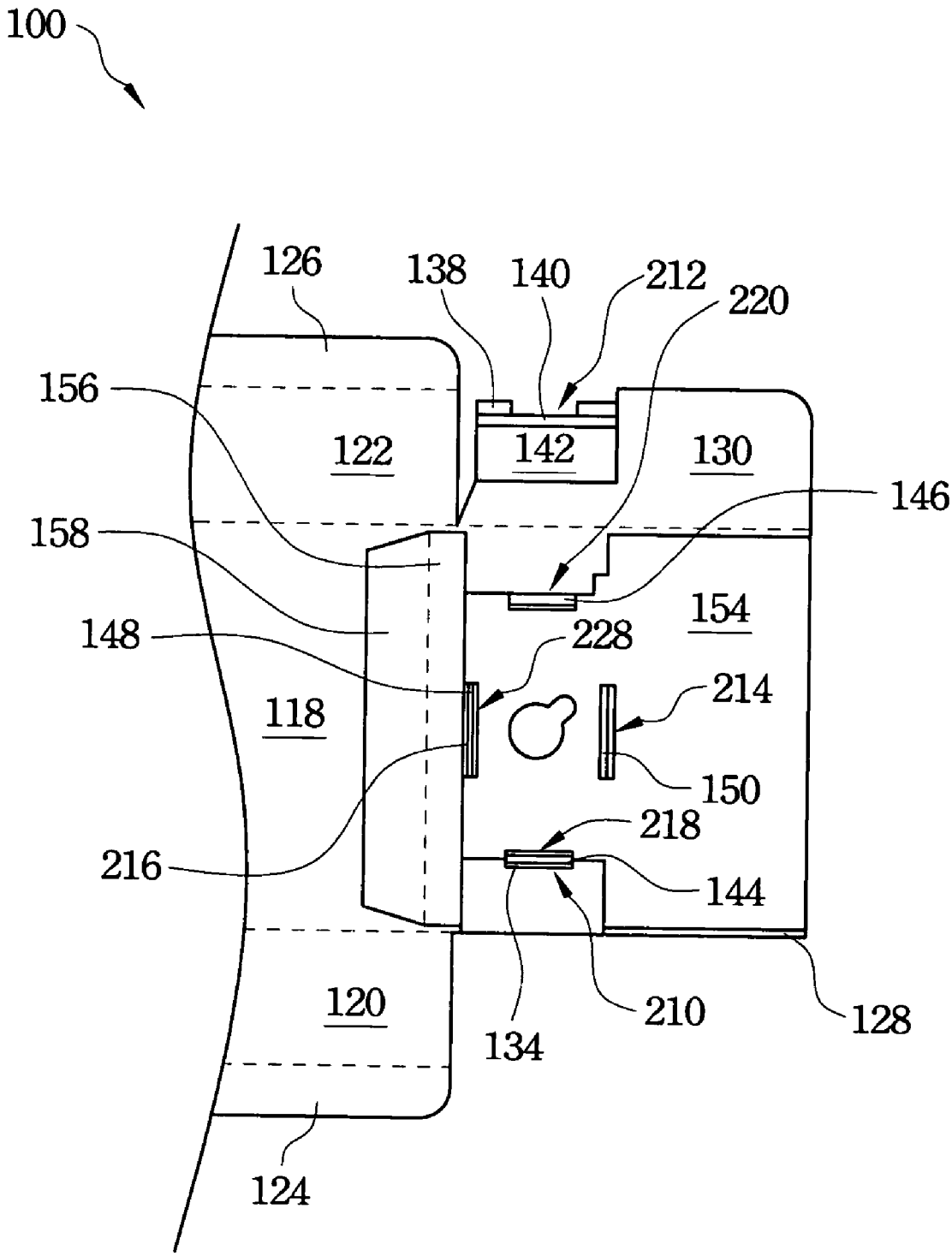

Next, the support piece 128, the bottom piece 132, the buckling piece 134 and the connection piece 136 are folded downward, the bottom piece 132 is folded toward the inner of the top plate 118, and the buckling piece 134 and the connection piece 136 are folded, wherein after folding the buckling piece 134, a buckling hole 210 is formed between the bottom piece 132 and the buckling piece 134, such as shown in FIG. 3D. After the buckling piece 134 and the connection piece 136 are folded, the connection piece 136 is connected with the top plate 118, the buckling piece 134 is connected with the buckling piece 144, and the buckling piece 144 is stuck and buckled in the buckling hole 210, such as shown in FIG. 3D. The buckling opening 218 is covered by the bottom piece 132.

Figure 3E:
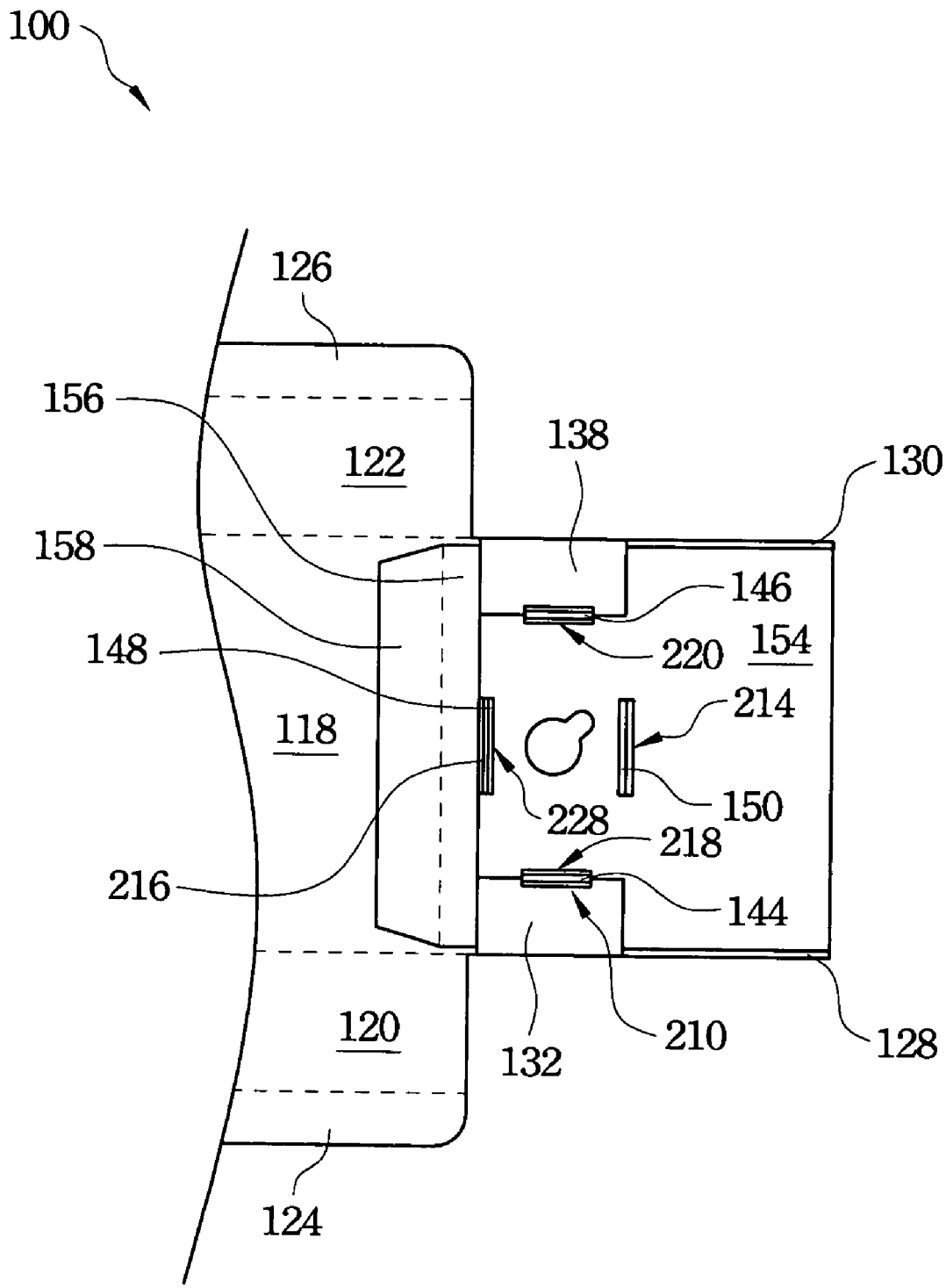
Figure 3F:
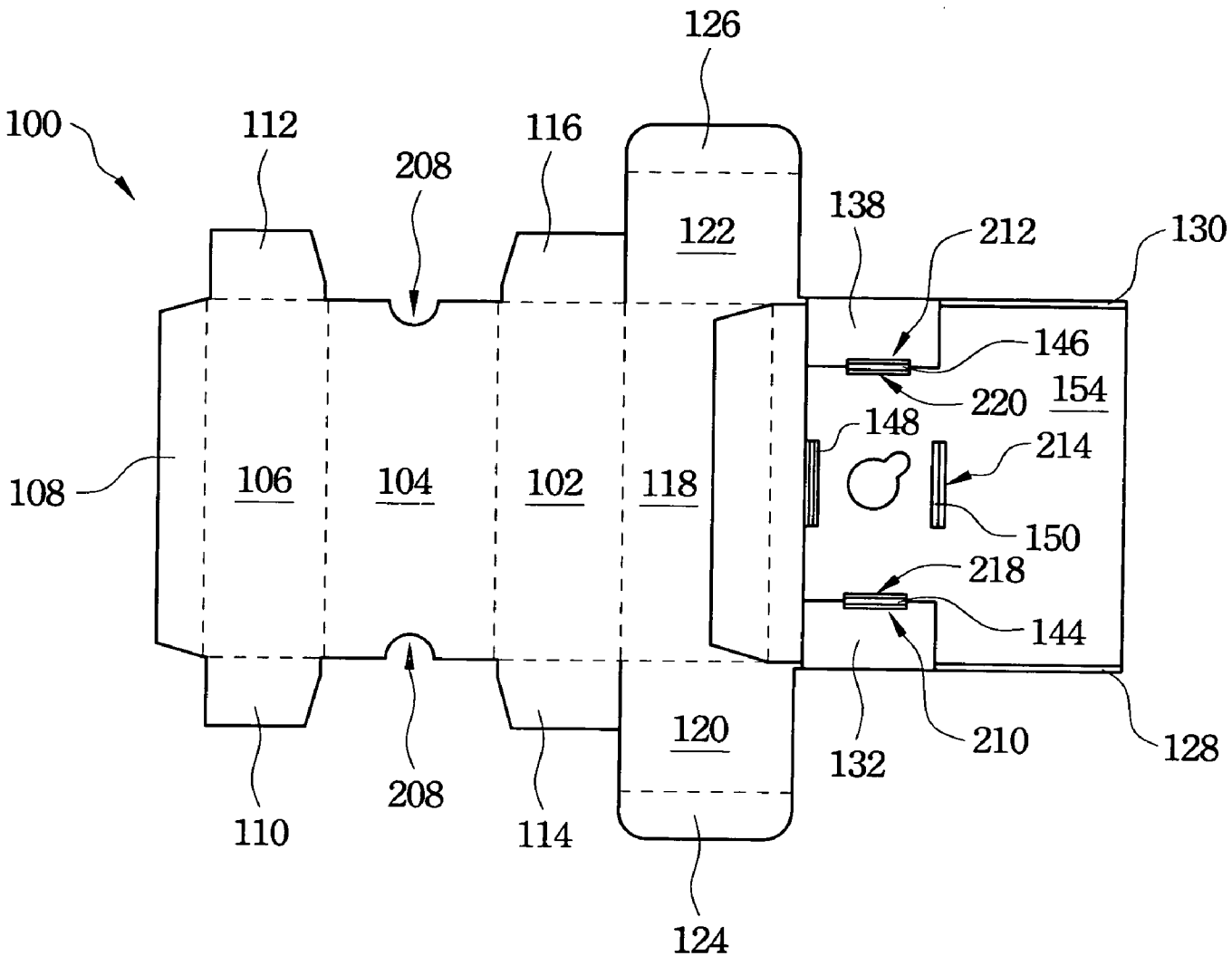

Similarly, the support piece 130, the bottom piece 138, the buckling piece 140 and the connection piece 142 are folded downward, the bottom piece 138 is folded toward the inner of the top plate 118, and the buckling piece 140 and the connection piece 142 are folded, wherein after the buckling piece 140 is folded, a buckling hole 212 is formed between the bottom piece 138 and the buckling piece 140. After the buckling piece 140 and the connection piece 142 are folded, the connection piece 142 is connected with the top plate 118, the buckling piece 140 is connected with the buckling piece 146, and the buckling piece 146 is stuck and buckled in the buckling hole 212, such as shown in FIG. 3E and FIG. 2A. The buckling opening 220 is covered by the bottom piece 138. At present, the fabrication of the stereoscopic inner spacer 100 is not completed, the top plate 118 is supported by the support piece 128 and the support piece 130, and the connection piece 158 extends under the top plate 118, such as shown in FIG. 3F. In another embodiment of the present invention, a lower surface of each support piece 128 and support piece 130 is selectively tied with a support element (not shown), wherein after the support elements are folded, two hollow rectangular structures are formed, the hollow rectangular structures are respectively located between the top plate 118 and the bottom piece 132 and between the top plate 118 and the bottom piece 138, and are further respectively located between the support piece 128 and the buckling piece 144 and between the support piece 130 and the buckling piece 146 for supporting the deposed space 222.

Figure 3G:
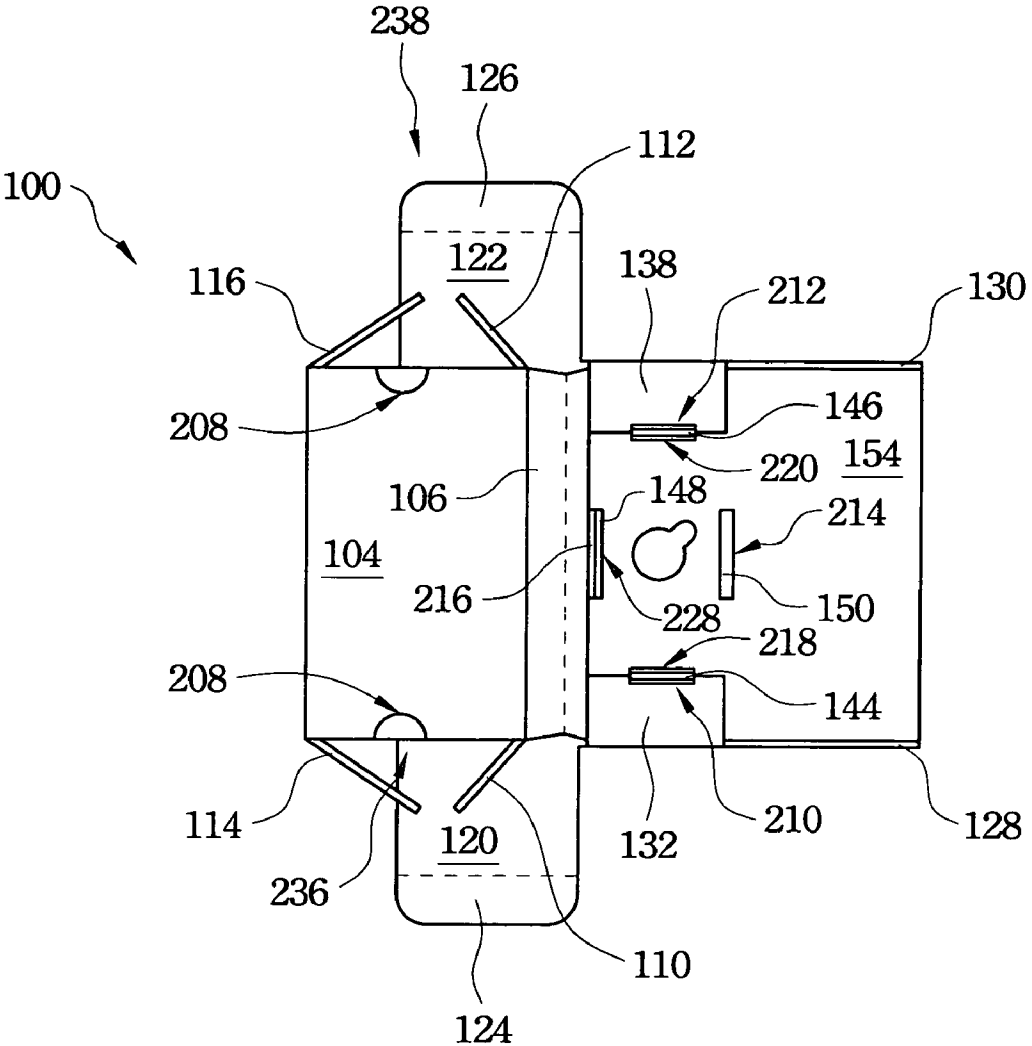

Then, the side plate 238 is folded inward to the top plate 118 to make the side piece 106 be connected with the side piece 156, to make the side piece 102 opposite to the side piece 106 with regard to the bottom piece 104, and to make the connection piece 108 be stacked with the connection piece 158, wherein the connection piece 158 is clipped between the connection piece 108 and the top plate 118, such as shown in FIG. 3G. Next, the cover piece 110, the cover piece 112, the cover piece 114 and the cover piece 116 are respectively folded inward, the side piece 122 is folded to cover the cover piece 112 and the cover piece 116, the side piece 120 is folded to cover the cover piece 110 and the cover piece 114, the inserted piece 126 is inserted into the slit between the cover piece 112 and the bottom piece 104 and between the cover piece 116 and the bottom piece 104, and the inserted piece 124 is inserted into the slit between the cover piece 110 and the bottom piece 104 and between the cover piece 114 and the bottom piece 104, so as to make the side plate 238 and a portion of the top plate 118 form a hidden rectangular deposed space 236 under the top plate 118, such as shown in FIG. 2B and FIG. 2C. At present, two openings 208 set on two opposite sides of the bottom piece 104 respectively expose a portion of the inserted piece 124 and the inserted piece 126 for a benefit for opening the deposed space 236 conveniently, such as shown in FIG. 2C.

Figure 4:
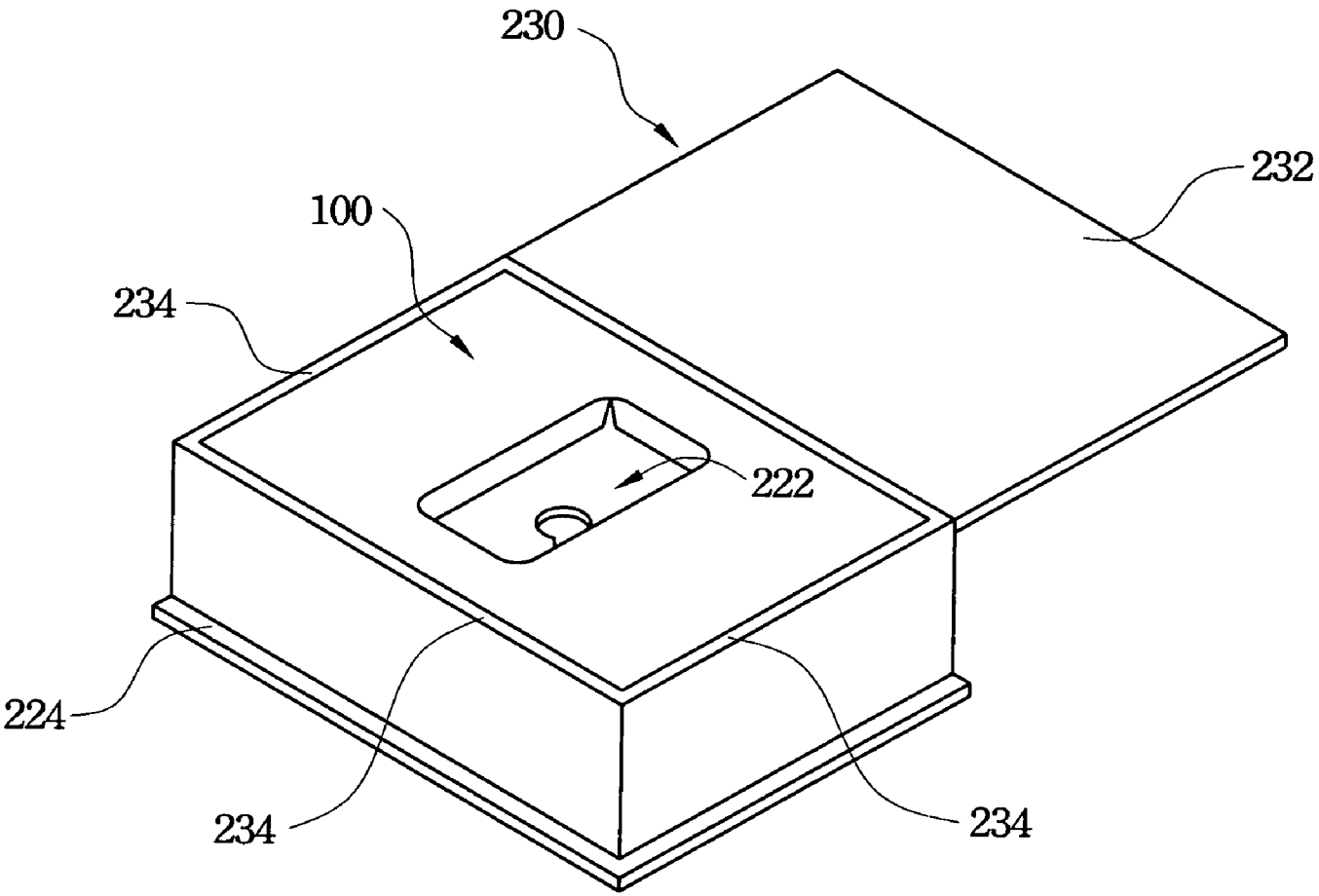
FIG. 4 illustrates a 3-D diagram showing a stereoscopic inner spacer according to a preferred embodiment of the present invention deposited within a packaging carton.

Referring to FIG. 4, the stereoscopic inner spacer 100 may be deposited within a packaging carton 230 to package the objects in the packaging carton 230. Typically, the packaging carton 230 comprises a bottom plate 224, a side plate 234 set around the rim of the bottom plate 224 and a lid 232 connected to an upper side of the side plate 234. After the fabrication is completed, the stereoscopic inner spacer 100 is put into the packaging carton 230 to make the open deposed space 222 upward, and then the lid 232 is closed to complete the packaging carton with an independent and open deposed space.

According to the aforementioned description, the stereoscopic inner spacer is fabricated simply by folding and buckling, so that the stereoscopic inner spacer has the advantages of easy production, saved the fabrication time and enhanced fabrication efficiency.

According to the aforementioned description, the stereoscopic inner spacer is made of paper materials, so that the burden of environment is reduced and the requirement of environmental protection is fulfilled.

According to the aforementioned description, the stereoscopic inner spacer is fabricated by folding and buckling a paper sheet, so that the stereoscopic inner spacer has the advantages of not needing to develop and fabricate molds, thus saving the cost of developing and fabricating the molds to reduce the expense.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A stereoscopic inner spacer, suitable for supporting a plurality of objects in a packaging carton, and the stereoscopic inner spacer comprises:

a top plate including a first side, a second side opposite to the first side, a third side and a fourth side opposite to the third side, and comprising a first portion and a second portion, wherein the first portion is set with a first buckling piece, a second buckling piece, a third buckling piece and a fourth buckling piece respectively corresponding to the first side, the second side, the third side and the fourth side of the top plate;

a first side plate comprising a first side piece, a first bottom piece and a second side piece connected to the first side of the top plate in sequence;

a second side plate comprising a third side piece, a second bottom piece and a fourth side piece connected to the second side of the top plate in sequence, wherein the fourth side piece comprises a buckling portion protruding in the second bottom piece, a first buckling hole is formed between the second bottom piece and the fourth side piece after folding the fourth side piece, the second bottom piece is set with a second buckling hole, and the second bottom piece is further set with a first buckling opening and a second buckling opening respectively located on two opposites sides of the second bottom piece adjacent to the second side of the top plate;

a third side plate comprising a fifth side piece and a first inserted piece connected to a portion of the third side of the top plate in sequence, and a first support piece, a third bottom piece and a fifth buckling piece connected to another portion of the third side of the top plate in sequence, wherein the fifth buckling piece is set with a third buckling hole; and a fourth side plate comprising a sixth side piece and a second inserted piece connected to a portion of the fourth side of the top plate in sequence, and a second support piece, a fourth bottom piece and a sixth buckling piece connected to another portion of the fourth side of the top plate in sequence, wherein the sixth buckling piece is set with a fourth buckling hole, the portion of the third side and the portion of the fourth side of the top plate are on two opposite sides of the first portion of the top plate, and the first support piece and the second support piece are folded downward to provide support under the top plate;

wherein, the second side plate is located under the top plate after folding, the first buckling piece is buckled into the first buckling hole, the second buckling piece is buckled into the second buckling hole, the third buckling piece is buckled into the first buckling opening and the third buckling hole, and the fourth buckling piece is buckled into the second buckling opening and the fourth buckling hole, so as to form an open deposed space in the first portion of the top plate;

wherein, the first side plate, the fifth side piece, the sixth side piece, the first inserted piece, the second inserted piece and the second portion of the top plate are folded to form a rectangular deposed space under the top plate.

2. The stereoscopic inner spacer according to claim 1, wherein the first side plate further comprises four cover pieces respectively connected to two opposite sides of the first side piece and two opposite sides of the second side piece, and the fifth side piece and the sixth side piece cover the covers pieces.

3. The stereoscopic inner spacer according to claim 2, wherein the first inserted piece and the second inserted piece are respectively inserted into slits between the first bottom piece and the cover pieces.

4. The stereoscopic inner spacer according to claim 3, wherein the first bottom piece is set with two opening holes on two opposite sides of the first bottom piece, and the opening holes respectively expose a portion of the first inserted piece and a portion of the second inserted piece.

5. The stereoscopic inner spacer according to claim 1, wherein the first side plate further comprises a first connection piece connected to the second side piece and opposite to the first bottom piece.

6. The stereoscopic inner spacer according to claim 5, wherein the second side plate further comprises a second connection piece connected to the fourth side piece and opposite to the second bottom piece.

7. The stereoscopic inner spacer according to claim 6, wherein the second connection piece is located between the second portion of the top plate and the first connection piece.

8. The stereoscopic inner spacer according to claim 1, wherein the third side plate further comprises a third connection piece connected to the fifth buckling piece and opposite to the third bottom piece, and the third connection piece is connected with the top plate.

9. The stereoscopic inner spacer according to claim 8, wherein the fourth side plate further comprises a fourth connection piece connected to the sixth buckling piece and opposite to the fourth bottom piece, and the fourth connection piece is connected with the top plate.

10. The stereoscopic inner spacer according to claim 1, wherein the third buckling hole is located between the fifth buckling piece and the third bottom piece, and is formed after folding the fifth buckling piece.

11. The stereoscopic inner spacer according to claim 10, wherein the fourth buckling hole is located between the sixth buckling piece and the fourth bottom piece, and is formed after folding the sixth buckling piece.

12. The stereoscopic inner spacer according to claim 1, wherein the third buckling hole is through the fifth buckling piece.

13. The stereoscopic inner spacer according to claim 12, wherein the fourth buckling hole is through the sixth buckling piece.

14. The stereoscopic inner spacer according to claim 1, wherein each of the first buckling opening and the second buckling opening is a sawtooth opening.

15. The stereoscopic inner spacer according to claim 14, wherein the third bottom piece and the fourth bottom piece respectively cover the first buckling opening and the second buckling opening.

16. The stereoscopic inner spacer according to claim 1, wherein a material of the stereoscopic inner spacer is a paper material having a buffer layer.

17. The stereoscopic inner spacer according to claim 1, wherein a material of the stereoscopic inner spacer is corrugated paper or bond paper.

18. The stereoscopic inner spacer according to claim 1, further comprises two support elements are respectively connected to an undersurface of the first support piece and an undersurface of the second support surface, wherein after folding the support elements forms two hollow rectangular structures respectively between the top plate and the third bottom piece and between the top plate and the fourth bottom piece, and further respectively between the first support piece and the third buckling piece and between the second support piece and the fourth buckling piece.

19. A stereoscopic inner spacer, suitable for supporting a plurality of objects in a packaging carton, and the stereoscopic inner spacer comprises:

a top plate including a first side, a second side opposite to the first side, a third side and a fourth side opposite to the third side, and comprising a first portion and a second portion, wherein the first portion is set with a first buckling piece, a second buckling piece, a third buckling piece and a fourth buckling piece respectively corresponding to the first side, the second side, the third side and the fourth side of the top plate;

a first side plate comprising a first side piece, a first bottom piece, a second side piece and a first connection piece connected to the first side of the top plate in sequence, and four cover pieces respectively connected to two opposite sides of the first side piece and two opposite sides of the second side piece;

a second side plate comprising a third side piece, a second bottom piece, a fourth side piece and a second connection piece connected to the second side of the top plate in sequence, wherein the fourth side piece comprises a buckling portion protruding in the second bottom piece, a first buckling hole is formed between the second bottom piece and the fourth side piece after folding the fourth side piece, the second bottom piece is set with a second buckling hole, and the second bottom piece is further set with a first buckling opening and a second buckling opening respectively located on two opposites sides of the second bottom piece adjacent to the second side of the top plate;

a third side plate comprising a fifth side piece and a first inserted piece connected to a portion of the third side of the top plate in sequence, and a first support piece, a third bottom piece and a fifth buckling piece connected to another portion of the third side of the top plate in sequence, wherein the fifth buckling piece is set with a third buckling hole; and a fourth side plate comprising a sixth side piece and a second inserted piece connected to a portion of the fourth side of the top plate in sequence, and a second support piece, a fourth bottom piece and a sixth buckling piece connected to another portion of the fourth side of the top plate in sequence, wherein the sixth buckling piece is set with a fourth buckling hole, the portion of the third side and the portion of the fourth side of the top plate are on two opposite sides of the first portion of the top plate, and the first support piece and the second support piece are folded downward to provide support under the top plate;

wherein, the second side plate is located under the top plate after folding, the first buckling piece is buckled into the first buckling hole, the second buckling piece is buckled into the second buckling hole, the third buckling piece is buckled into the first buckling opening and the third buckling hole, and the fourth buckling piece is buckled into the second buckling opening and the fourth buckling hole, so as to form an open deposed space in the first portion of the top plate;

wherein, the first side plate, the fifth side piece, the sixth side piece, the first inserted piece, the second inserted piece and the second portion of the top plate are folded to form a rectangular deposed space under the top plate, the second connection piece is located between the second portion of the top plate and the first connection piece, and the fifth side piece and the sixth side piece cover the cover pieces.

20. The stereoscopic inner spacer according to claim 19, further comprises two support elements are respectively connected to an undersurface of the first support piece and an undersurface of the second support surface, wherein after folding the support elements forms two hollow rectangular structures respectively between the top plate and the third bottom piece and between the top plate and the fourth bottom piece, and further respectively between the first support piece and the third buckling piece and between the second support piece and the fourth buckling piece.

* * * * *